US006186166B1

(12) United States Patent
Myers

(10) Patent No.: US 6,186,166 B1
(45) Date of Patent: Feb. 13, 2001

(54) FIRE HOSE RELEASE DEVICE

(75) Inventor: John M. Myers, Duncannon, PA (US)

(73) Assignee: Myers Quick Drop, Inc., Duncannon, PA (US)

( * ) Notice: Under 35 U.S.C. 154(b), the term of this patent shall be extended for 0 days.

(21) Appl. No.: 09/371,200

(22) Filed: Aug. 10, 1999

Related U.S. Application Data

(60) Provisional application No. 60/095,951, filed on Aug. 10, 1998.

(51) Int. Cl.[7] ..... A62C 35/00; B65H 75/34

(52) U.S. Cl. ..... 137/355.16; 137/355.12; 137/355.2 C; 137/355.28; 137/899; 137/351

(58) Field of Search ..... 137/355.16, 355.26, 137/355.28, 899, 351

(56) References Cited

U.S. PATENT DOCUMENTS

| | | | | |
|---|---|---|---|---|
| 504,624 | | 9/1893 | Schenck . | |
| 521,868 | | 6/1894 | Shay . | |
| 975,245 | | 11/1910 | Hughes . | |
| 1,704,825 | * | 3/1929 | Duesler | 280/4 |
| 1,901,660 | * | 3/1933 | Lund | 137/355.26 |
| 2,010,811 | * | 8/1935 | Craig | 137/355.26 |
| 2,053,654 | * | 9/1936 | Davis | 137/355.26 |
| 2,071,731 | | 2/1937 | Craig et al. | 299/78 |
| 2,138,970 | | 12/1938 | Jones | 244/136 |
| 2,139,484 | | 12/1938 | Baird | 242/88 |
| 2,320,477 | * | 6/1943 | Souther | 137/355.26 |
| 2,384,395 | | 9/1945 | Payne | 94/39 |
| 2,403,277 | | 7/1946 | Hall | 60/62.5 |
| 2,426,984 | | 9/1947 | Craig | 242/86 |
| 2,436,402 | | 2/1948 | Potter | 175/376 |
| 2,480,764 | | 8/1949 | Pennington | 1/49.7 |
| 2,490,837 | | 12/1949 | Scott, Jr. | 244/137 |
| 2,625,404 | | 1/1953 | Treiber | 280/4 |
| 2,757,958 | | 8/1956 | Bussey et al. | 299/30 |
| 2,780,430 | * | 2/1957 | Pokryfke | 137/355.28 |
| 2,912,151 | | 11/1959 | Crabs | 224/50 |
| 3,169,581 | | 2/1965 | Cummins | 169/24 |
| 3,171,430 | | 3/1965 | Lovell et al. | 137/355.12 |
| 3,183,927 | * | 5/1965 | Weese et al. | 137/355.28 |
| 3,184,180 | | 5/1965 | Rockwell | 242/86 |
| 3,340,522 | | 9/1967 | Chick et al. | 340/274 |
| 3,381,705 | * | 5/1968 | Murphy | 137/355.28 |
| 3,576,196 | | 4/1971 | Atanosian | 137/355.26 |
| 3,590,854 | | 7/1971 | Cork | 137/355.16 |
| 3,722,823 | | 3/1973 | Reich et al. | 242/86 |
| 3,850,380 | | 11/1974 | Kranefeld | 242/54 R |
| 4,288,047 | | 9/1981 | Berry et al. | 242/86 |
| 4,306,688 | | 12/1981 | Hechler, IV | 242/86 |
| 4,325,058 | | 4/1982 | Wagner et al. | 340/562 |
| 4,520,239 | | 5/1985 | Schwartz | 191/12.4 |
| 4,537,215 | | 8/1985 | Roman | 137/355.26 |
| 4,671,315 | | 6/1987 | Gardner | 137/355.12 |
| 4,730,180 | | 3/1988 | Riddell et al. | 340/52 R |
| 4,774,979 | * | 10/1988 | McKeon et al. | 137/351 |
| 4,858,797 | | 8/1989 | Rabska | 224/162 |
| 4,886,282 | | 12/1989 | Wilkinson et al. | 280/4 |
| 4,971,092 | * | 11/1990 | Parry et al. | 137/351 |
| 4,979,693 | | 12/1990 | Eberhardt et al. | 242/96 |
| 5,205,509 | | 4/1993 | Noggle | 242/86 |
| 5,211,351 | | 5/1993 | DeClerck | 242/86.2 |
| 5,678,599 | * | 10/1997 | Moss | 137/377 |
| 5,722,453 | * | 3/1998 | Huxhold | 137/355.28 |

* cited by examiner

*Primary Examiner*—A. Michael Chambers
*Assistant Examiner*—Thomas L. McShane
(74) *Attorney, Agent, or Firm*—Webb Ziesenheim Logsdon Orkin & Hanson, P.C.

(57) ABSTRACT

This invention generally relates to rescue, firefighting, or paying devices and, more particularly, to a fire hose dispensing device and method. The present invention includes a hose box, fire hose, and a hose box release mechanism. The device and method allow firefighters to release and pay hose without leaving the passenger compartment of a fire truck.

25 Claims, 9 Drawing Sheets

FIRE HOSE RELEASE DEVICE

CROSS-REFERENCE TO RELATED APPLICATION

This application claims the benefit of earlier filed U.S. Provisional Patent Application Ser. No. 60/095,951, filed Aug. 10, 1998, entitled "Fire Hose Release Device".

BACKGROUND OF THE INVENTION

1. Field of the Invention

The invention relates generally to the field of firefighting devices and, more particularly, to a hose dispenser for a fire apparatus such as a fire truck.

2. Description of the Prior Art

Connecting a fire hose between a fire truck and a water hydrant has traditionally been a time consuming and hazardous evolution. With early firefighting devices, a firefighter would typically ride on the rear deck of a moving fire apparatus, such as a truck or wagon, until a fire hydrant was located. The apparatus would stop and the firefighter would jump from the apparatus clutching one end of a folded two and one-half inch diameter hose. After wrapping the hose several times around the hydrant, the firefighter would jump back onto the apparatus. As the apparatus resumed its forward motion toward the fire, the hose in the bed of the apparatus would unroll. The entire process was moderately expedient, provided the firefighter was not injured by fire related hazards, slippery surfaces or adverse weather.

However, due to changes in equipment, coupled with health and safety concerns, the traditional method of paying hose from a fire truck became less efficient. First, both the diameter and length of supply hoses have increased, making the hoses heavier and harder to handle. Second, longer, thicker hoses occupied more space, forcing the hoses to be stacked higher on the fire truck. Lastly, federal and state safety regulations required firefighters, wearing full protective gear, to travel inside of a fire truck's passenger compartment. This combination of changes resulted in the modern method of paying hose. In the modern method, the fire truck is stopped next to an available hydrant. A fully-equipped firefighter jumps out of the fire truck's passenger compartment, runs the length of the truck to the end of the truck bed, leaps up onto the truck's rear deck, physically grabs an end of a hose located at eye level, pulls the hose away from the truck without losing his balance and falling backwards off of the rear deck, jumps from the rear deck to the ground, runs to a fire hydrant, wraps several turns of the hose around the hydrant, runs back to the truck, and steps back up into the truck's passenger compartment. Once the fireman is inside, the truck restarts and continues toward the fire. This modern method is relatively time consuming and tiring for the firefighter, who must do all of these procedures wearing full protective gear. Valuable time is wasted which could be better spent in actually fighting the fire.

SUMMARY OF THE INVENTION

Ideally, firefighters should be able to pay hose without having to leave the safety of the fire truck. To help solve this problem, the present invention is directed toward an automatic supply hose dispensing system, generally including an ejection mount and a hose box releasably attached to the ejection mount. A supply hose may be positioned adjacent to and connectable with the hose box. The present invention allows a firefighter to release a supply hose from a fire truck without requiring the firefighter to leave the fire truck passenger compartment. In addition to saving valuable life-saving time, the present invention also enhances a firefighter's physical safety. Additionally, the present invention alerts passing motorists and pedestrians of the possibility of unwound hose during darkness, fog or other inclement conditions.

Therefore, it is an object of this invention to provide a means of discharging a supply hose segment, or similar equipment, without requiring firefighters to leave the fire truck's passenger compartment.

Another object of the invention is to decrease the amount of time needed to pay hose.

A further objective is to produce a hose paying system which alerts drivers to the exposed hose.

These and other advantages of the present invention will be clarified in the description of the preferred embodiments taken together with the attached drawings in which like reference numerals represent like elements throughout.

DETAILED DESCRIPTION OF THE PREFERRED EMBODIMENTS

Figure 1:
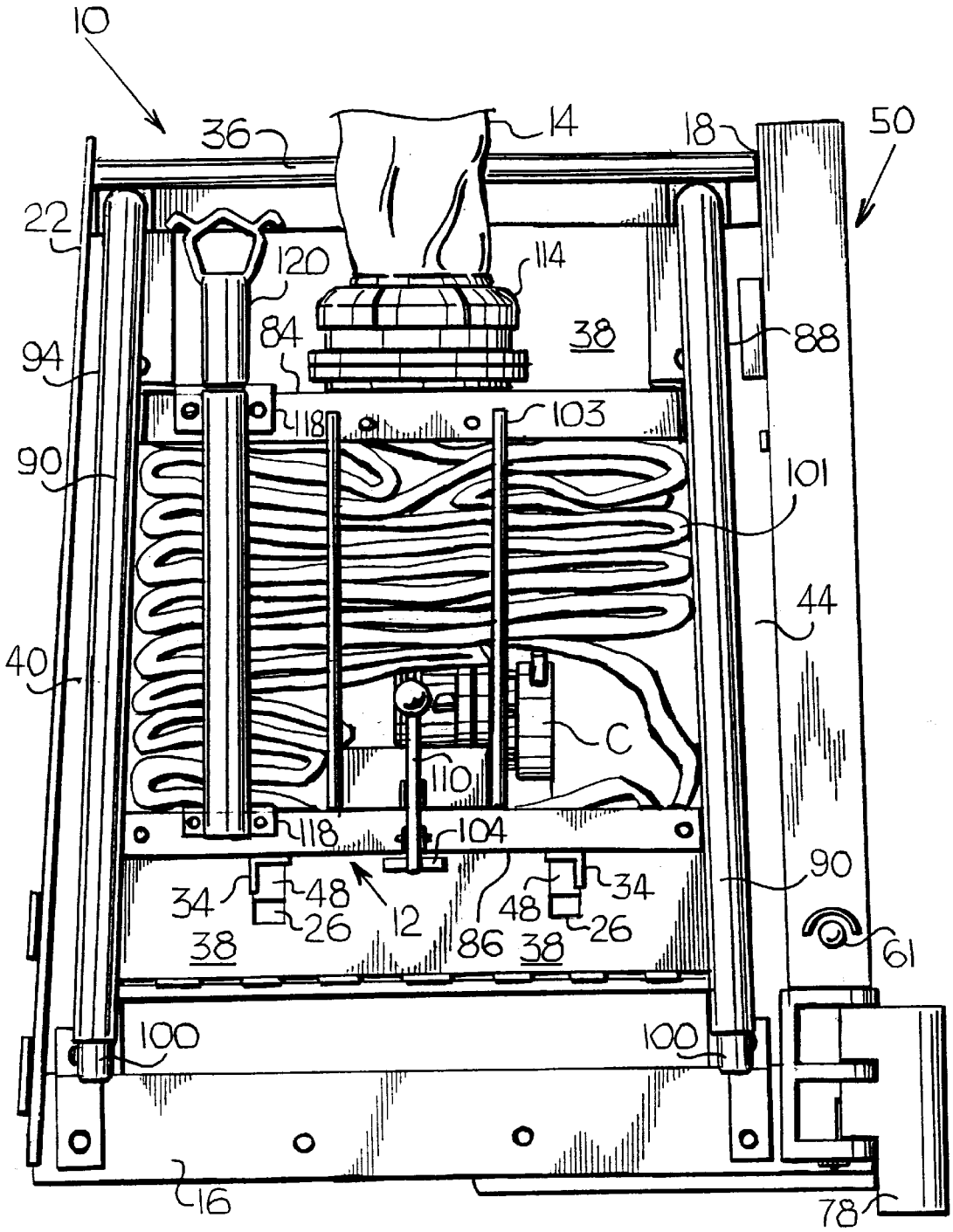
FIG. 1 is a front view of a hose box loaded onto an ejector mount, the hose box having a pivoting gate releasably secured by a latch.
Figure 2:
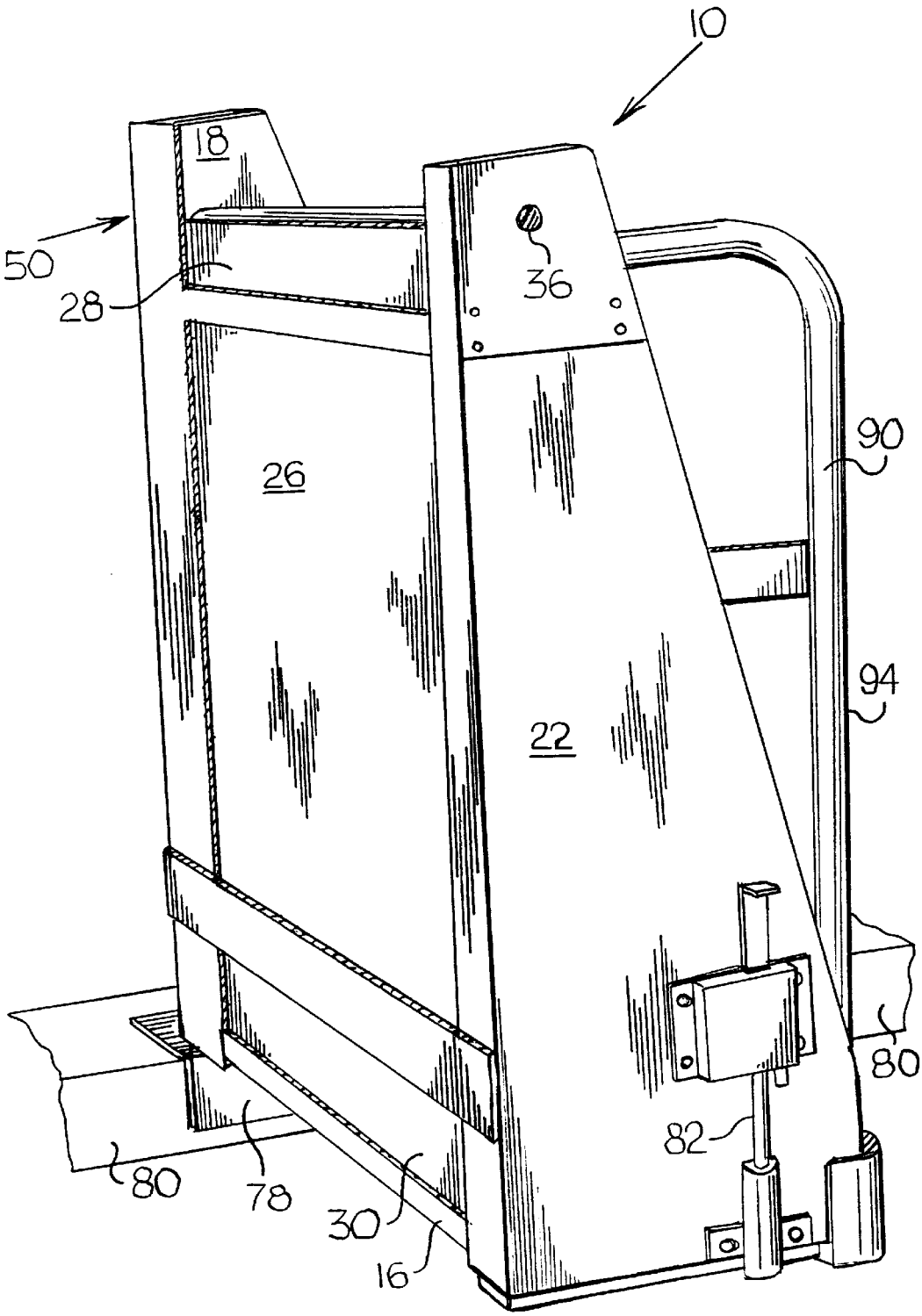
FIG. 2 is side view of the hose box and ejector mount shown in FIG. 1.

FIGS. 1 and 2 show the preferred embodiment of the present invention. In general, the hose paying system of the present invention generally includes an ejection mount 10 and a hose box 12 releasably attached to the ejection mount 10. A supply hose 14 may be positioned adjacent to and connectable with the hose box 12. As shown in FIG. 2, the ejection mount 10 preferably resembles a right triangle when viewed from the side, but the actual shape of the ejection mount 10 is irrelevant, so long as the hose box 12 can be releasably attached to the ejection mount 10.

Figure 3:
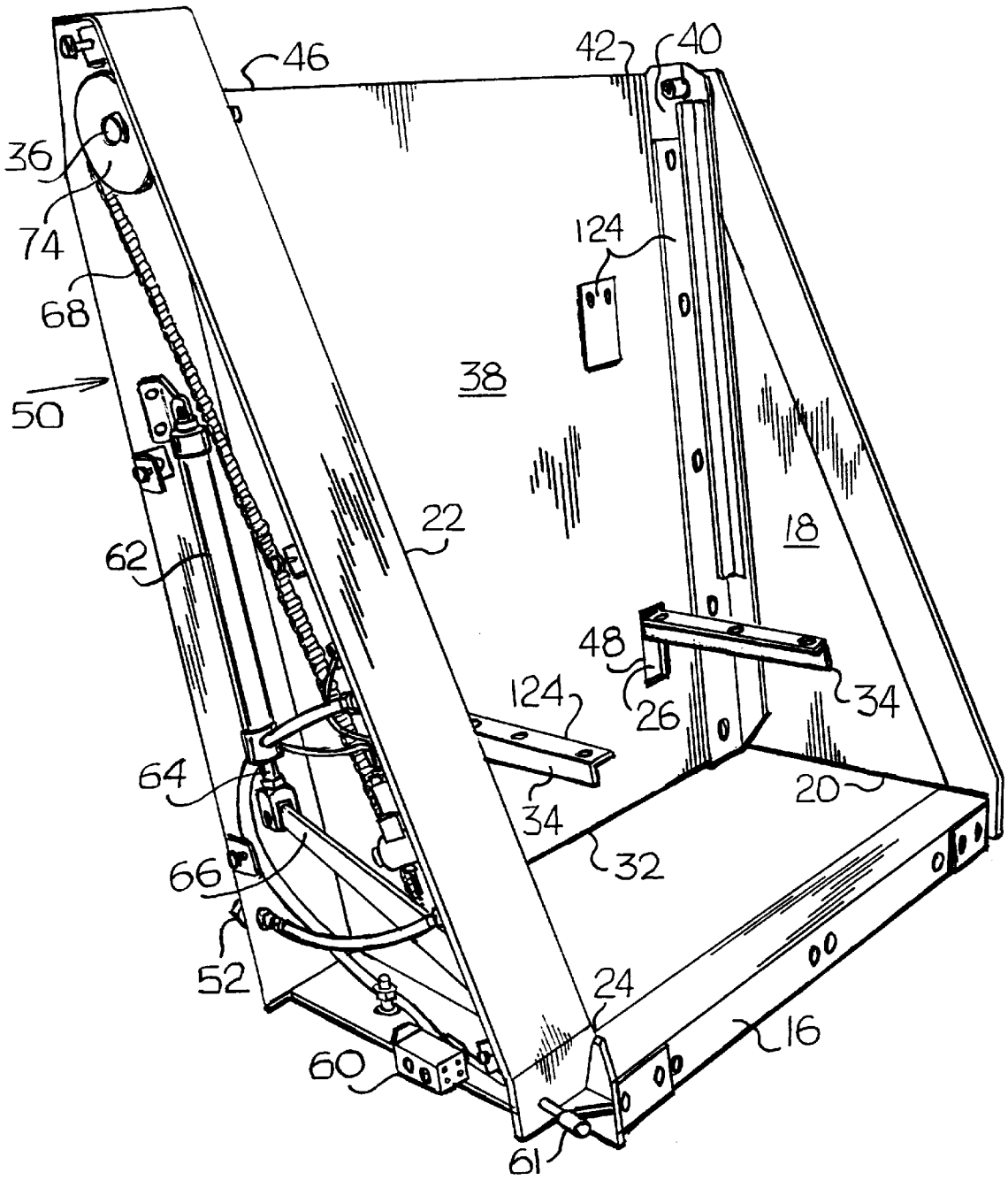
FIG. 3 is an elevated perspective view of an ejection mount with an ejector mount pivot wall in a closed position.
Figure 4:
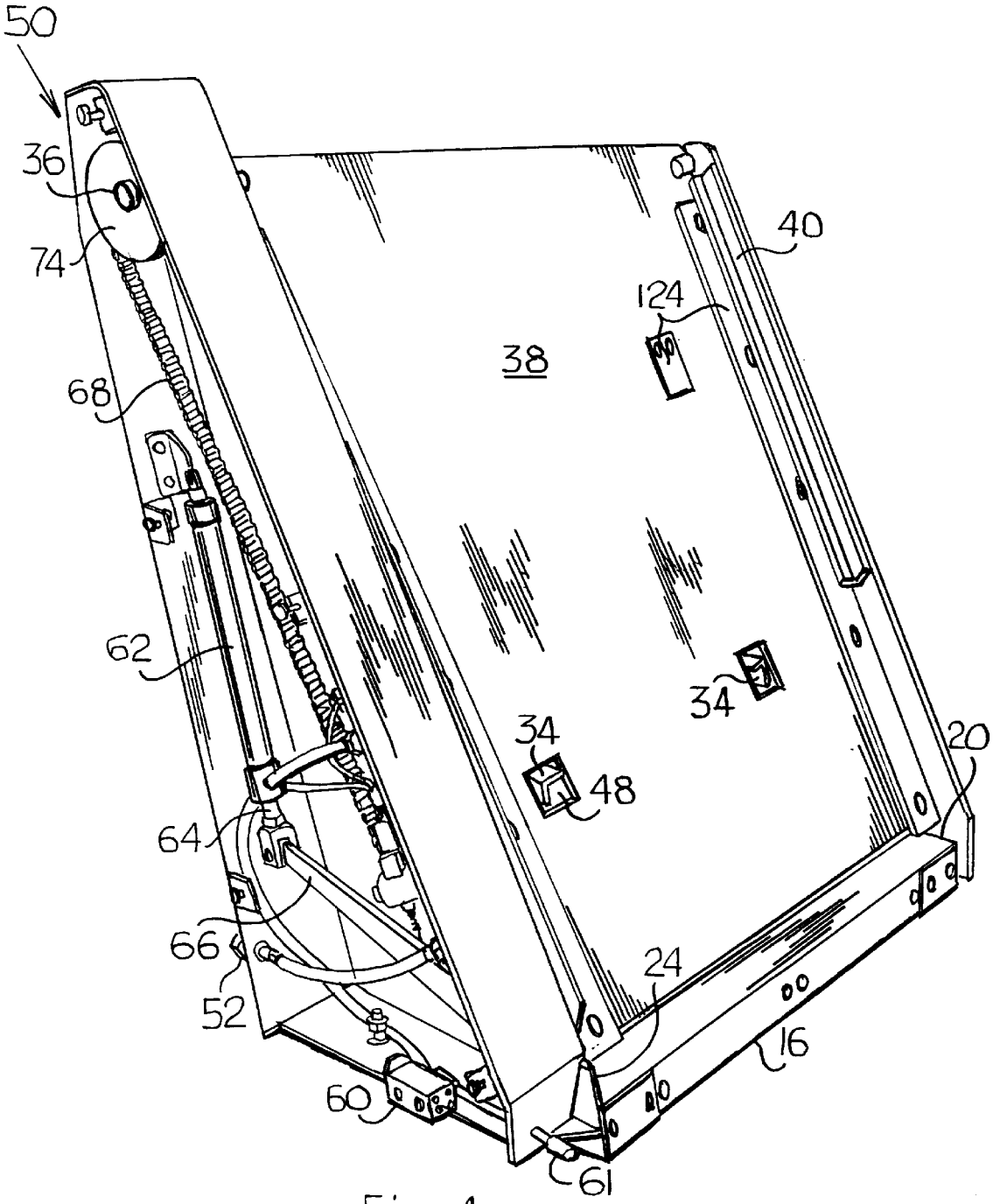
FIG. 4 is an elevated perspective view of the ejection mount shown in FIG. 3 with the ejector mount pivot wall in an open opposition.
Figure 5:
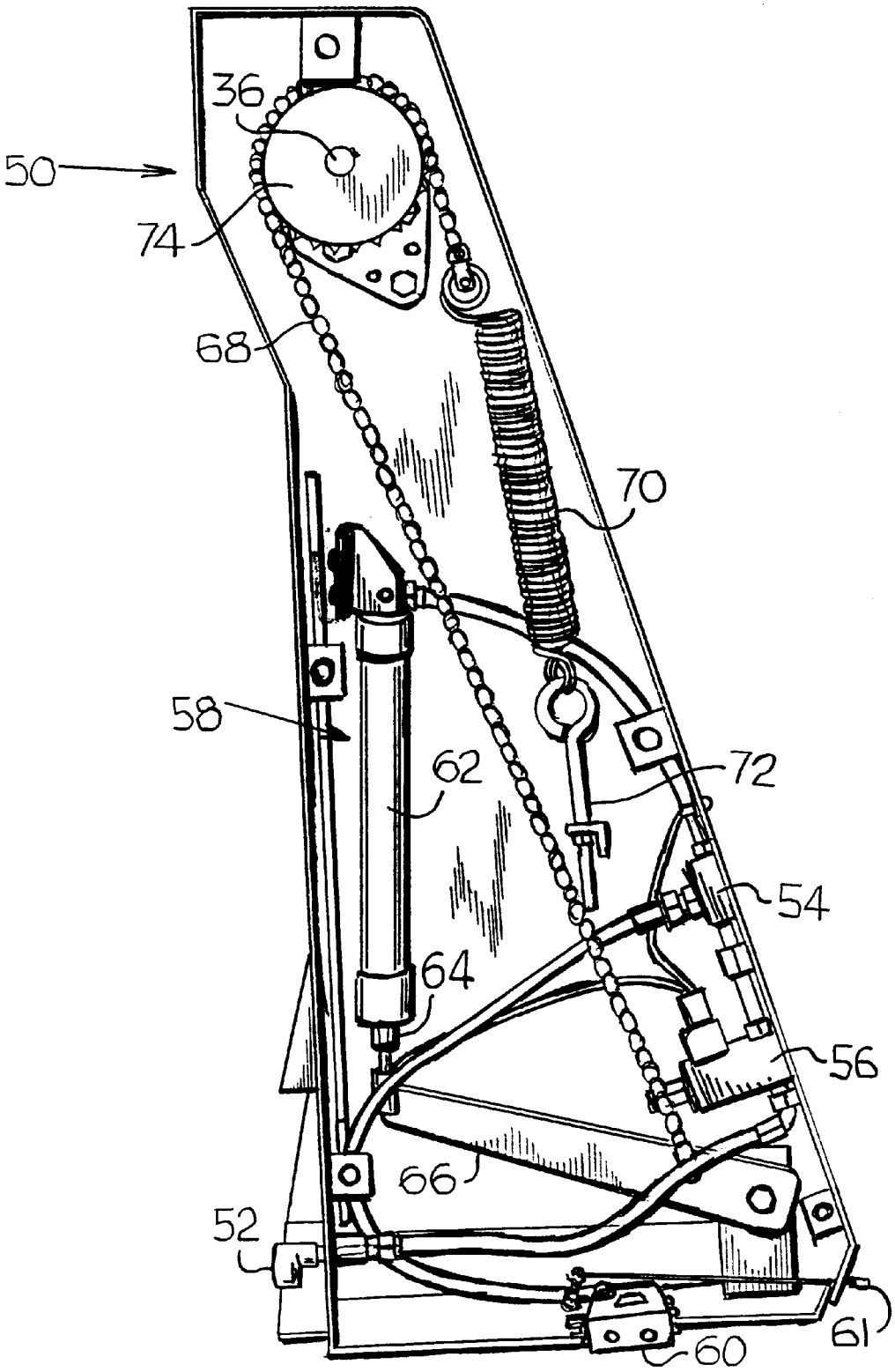
FIG. 5 is a side view of the ejection mount actuator assembly shown in FIG. 3.

As shown in FIGS. 1 and 2, and with more specificity in FIGS. 3–5, the ejection mount 10 has a base 16 and a first sidewall 18 positioned substantially perpendicularly adjacent to a first side 20 of the base 16. A second sidewall 22 is positioned substantially perpendicularly adjacent to a second side 24 of the base 16, substantially parallel to the first sidewall 18. A back wall 26, having a first end 28 and a second end 30, is positioned substantially perpendicularly adjacent to the first sidewall 18 and the second sidewall 22, with the second end 30 of the back wall 26 positioned adjacent a third side 32 of the base 16. A plurality of box support legs 34 extend from the back wall 26 and are positioned substantially perpendicularly adjacent the back wall 26, substantially parallel to the base 16. A rotatable pivot wall shaft 36 is positioned adjacent to the first end 28 of the back wall 26, between the first and second sidewalls 18, 22, substantially parallel to the base 16. A pivot wall 38 is connected to the pivot wall shaft 36, with the pivot wall 38 having a first box guide rail 40 positioned adjacent a first side 42 of the pivot wall 38 and a second box guide rail 44 positioned adjacent a second side 46 of the pivot wall 38. The pivot wall 38 also includes box support recesses 48 corresponding to or aligned with the box support legs 34, so that the box support legs 34 protrude through the pivot wall 38 when the pivot wall 38 is pivoted into a closed or loaded position, as shown in FIG. 3, or are completely obscured when the pivot wall 38 is pivoted into an open or unloaded position, as shown in FIG. 4. The pivot wall 38 is pivoted into an open or closed position by an actuator assembly 50 connected to the rotatable pivot wall shaft 36. FIGS. 1 and 2 show the actuator assembly 50 positioned adjacent the first sidewall 18 of the ejection mount 10, while FIGS. 3–5 show the actuator assembly 50 adjacent the second sidewall 22 of the ejection mount 10. Either configuration may be used depending on the needs of the user.

The actuator assembly 50, shown in detail in FIGS. 3–5, has a fluid inlet 52 that is connected to a fluid routing valve 54. The fluid routing valve 54 has a fluid routing switch 56 that routes a fluid, such as air or hydraulic fluid, into a jack 58 and a pressure relief valve 60. The fluid routing switch 56 may be controlled, i.e., opened or closed, for example, by fluid, electrical signal, or any other conventional means. In firefighting applications, a conventional electrical control device having an electrical signal switch activated inside the cab of a fire truck is the preferred method.

The jack 58 has a jack body 62 and jack extension 64, with the jack extension 64 connected to one end of a lever 66. The other end of the lever 66 is connected to one end of a chain 68. The other end of the chain 68 is connected to a bias spring 70 connected between the chain 68 and a spring mount 72. The chain 68 engages a rotatable sprocket 74 connected to a first end 76 of the pivot wall shaft 36.

The ejection mount 10 is preferably mounted on a vehicle, such as the rear portion of a fire truck hose bed. In one embodiment, shown in FIGS. 1 and 2, a swing out hinge mount 78 is attached to the rear step 80 of a fire truck and the ejection mount 10 is attached to the swing out hinge mount 78. The swing out hinge mount 78 allows firefighters to swing the ejection mount 10 out away from rear of the fire truck, e.g., up to about 170 degrees of rotational arc, allowing access to compartments accessible only from the rear of the fire truck. To prevent the ejection mount 10 from swinging out away from the rear of the truck during transit, a slide stop 82 is provided on either the first or second sidewall 18, 22 of the ejection mount 10, opposite the swing out hinge mount 78. The slide stop 82 engages a hole drilled into the rear bumper or step 80 of the fire truck. As an alternative, the back wall 26 of the ejection mount 10 may also be securely bolted directly to the fire truck, preferably adjacent a rear portion of the fire truck hose bed.

As shown generally in FIGS. 1 and 2, and explained more fully in the several successive paragraphs, the hose box 12 is releasably loaded onto the ejection mount 10 and is subsequently expelled from the ejection mount 10 onto a surface, such as the ground. As shown generally in FIGS. 1–9, the hose box 12 has a first end 84, a second end 86 positioned opposite the first end 84, a first sidewall 88, formed by a substantially L-shaped member 90 and an obtuse shaped member 92 positioned perpendicularly adjacent the first and second ends 84, 86, a second sidewall 94 formed by a second L-shaped member 90 and a second obtuse shaped member 92 and positioned opposite and parallel to the first sidewall 88, a top portion 96 positioned perpendicularly adjacent the first end 84, the second end 86, the first sidewall 88, and the second sidewall 94, and a base plate 98 forming a bottom portion positioned parallel to the top portion 96 and connecting the first and second sidewalls 88, 94. The top portion 96 can be open or closed and the first end 84, second end 86, first sidewall 88, and second sidewall form 94 an internal cavity 102. Although hose box 12 can assume many different geometrical shapes, sidewalls formed from substantially L-shaped and substantially obtuse shaped members 90, 92 provide two significant advantages. First, the shape of each sidewall 88, 94 allows pads 100 positioned on the sidewalls 88, 94 to contact the ground or other surface and cushion the impact of the hose box 12. Second, the obtuse shaped members 92 urge the bottom portion 98 of the hose box 12 towards the ground when the hose box 12 is ejected from the ejection mount 10, insuring that the hose box 12 will land with the top portion 96 of the hose box 12 facing away from the ground.

Figure 6:
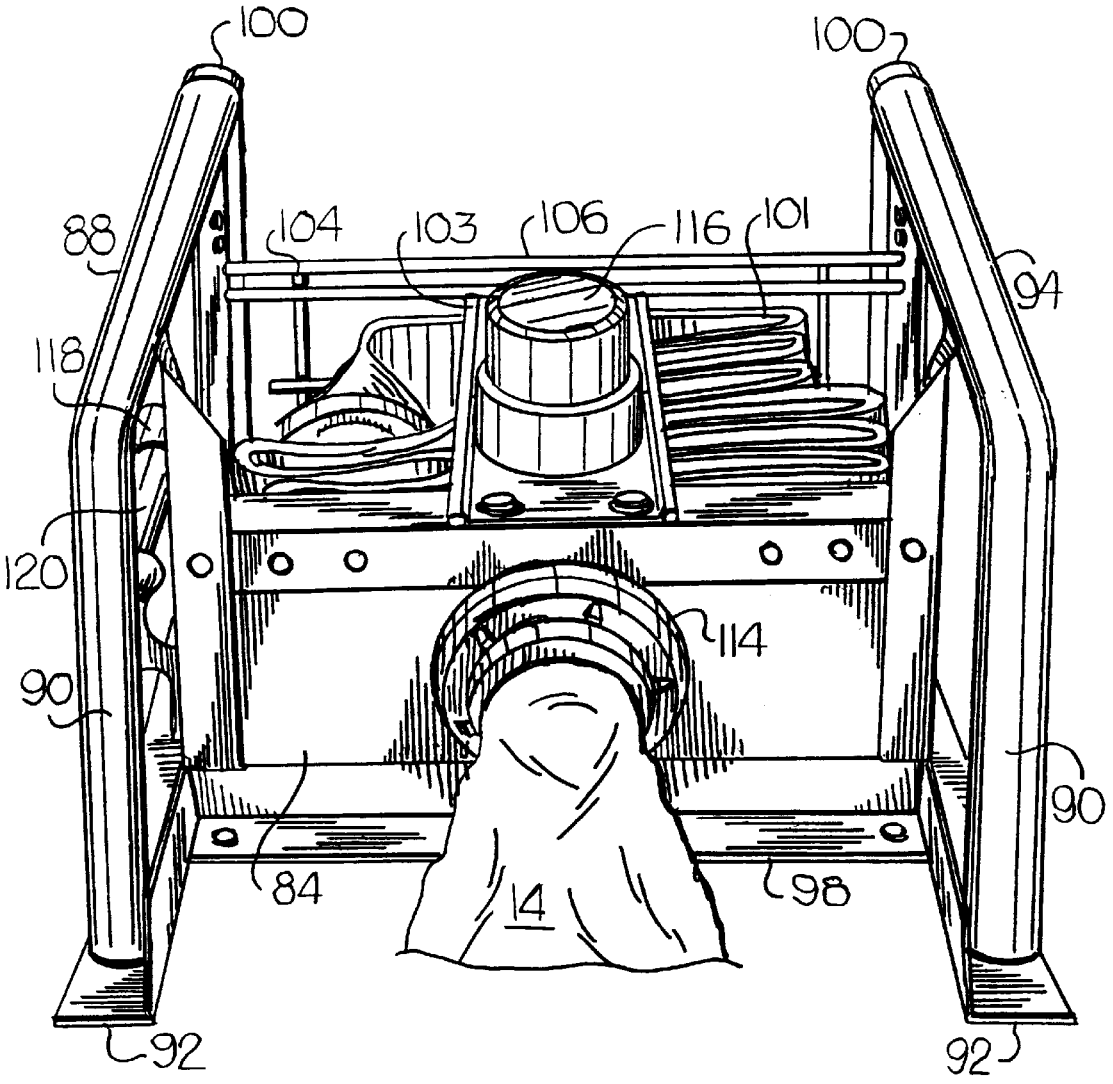
FIG. 6 is an elevated view of a first end of the hose box, a segment of hose folded inside the box, and a liftable gate adjacent a second end of the hose box.
Figure 7:
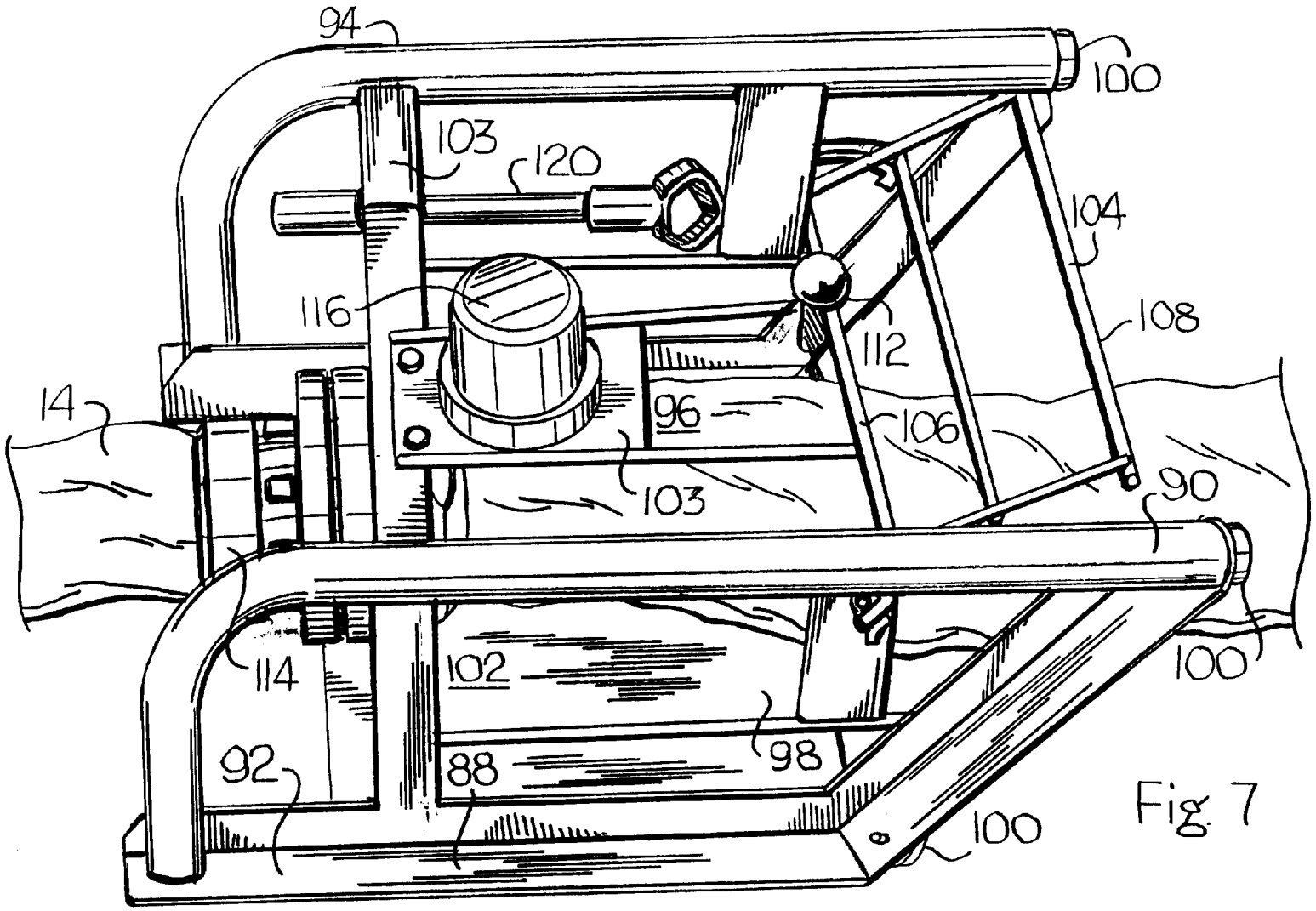
FIG. 7 is an elevated perspective view of the hose box shown in FIG. 6 with the segment of hose unfolded.
Figure 8:
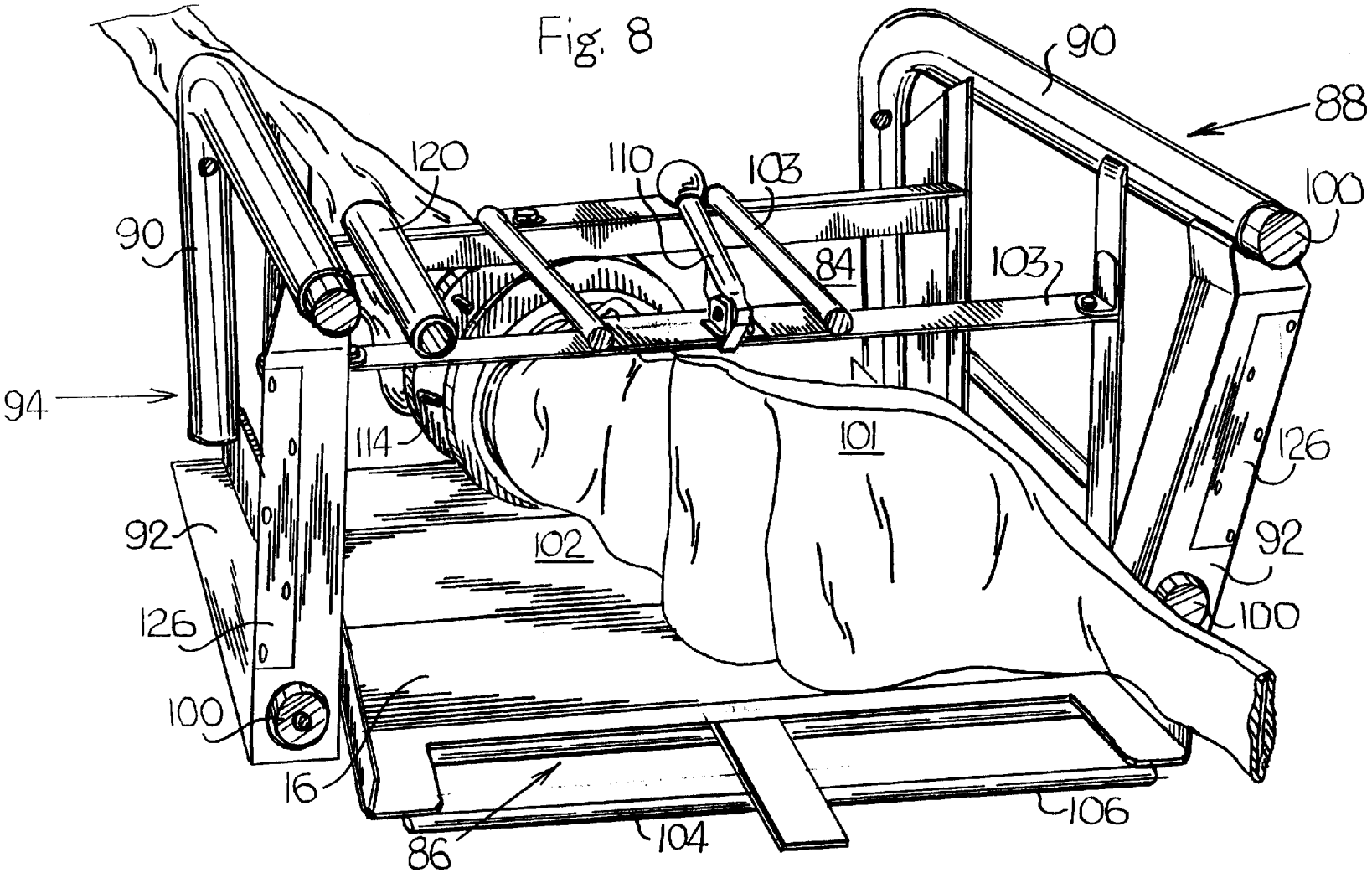
FIG. 8 an elevated perspective view of a hose box with a pivoting gate and a latch release.

In one embodiment of the hose box 12, shown in FIGS. 1 and 6–8, joining members 103 connect the first and second sidewalls 88, 94 or the first and second ends 84, 86 adjacent the top portion 96 of the hose box 12. The first end 84, second end 86, first sidewall 88, second sidewall 94, base 98, and joining members 103 form an internal cavity 102 within the hose box 12. The internal cavity 102 provides enough clearance to allow a folded hose 101, e.g., about 25 feet in length, having a hydrant connector C to be inserted into hose box 12. The folded hose 101 is inserted into the hose box 12 through a movable gate 104. The gate 104 has a first side 106 and a second side 108 and is positioned adjacent the second end 86 of the hose box 12. In the preferred embodiment, the second side 108 of the gate 104 is pivotally connected adjacent the bottom portion 98 of the hose box 12, with the first side 106 pivotally movable away from the top portion 96 of the hose box 12 into an open position. The gate 104 is held in a closed position by a movable latch 110 positioned adjacent the first side 106 of the gate 104. In a second embodiment, the first side 106 of the gate 104 is pivotally connected adjacent the top portion 96 of the hose box 12. The gate 104 is lifted into an open position with the assistance of a graspable gate knob 112. As shown in FIGS. 1 and 6–8, the first end 84 of the hose box 12 may contain a dual hose connector 114 positioned adjacent the first end 84 of the hose box 12 for connecting the supply hose 14 to the hose box 12 and then hose box 12, i.e., the hose 101, to a hydrant or other water source. FIGS. 6 and 7 show an optional battery powered light 116 positioned in a protected area of the hose box 12. The light 116 is connected to a light switch 24 (not shown) that activates upon release of the hose box 12 from the ejection mount 10. The protected area is preferably adjacent the top portion of the hose box 12. FIGS. 1 and 7–8 show tool clamps 27 attached to the sides of hose box 12 to allow the attachment of various firefighting tools 120, such as a hydrant wrench.

Figure 9:
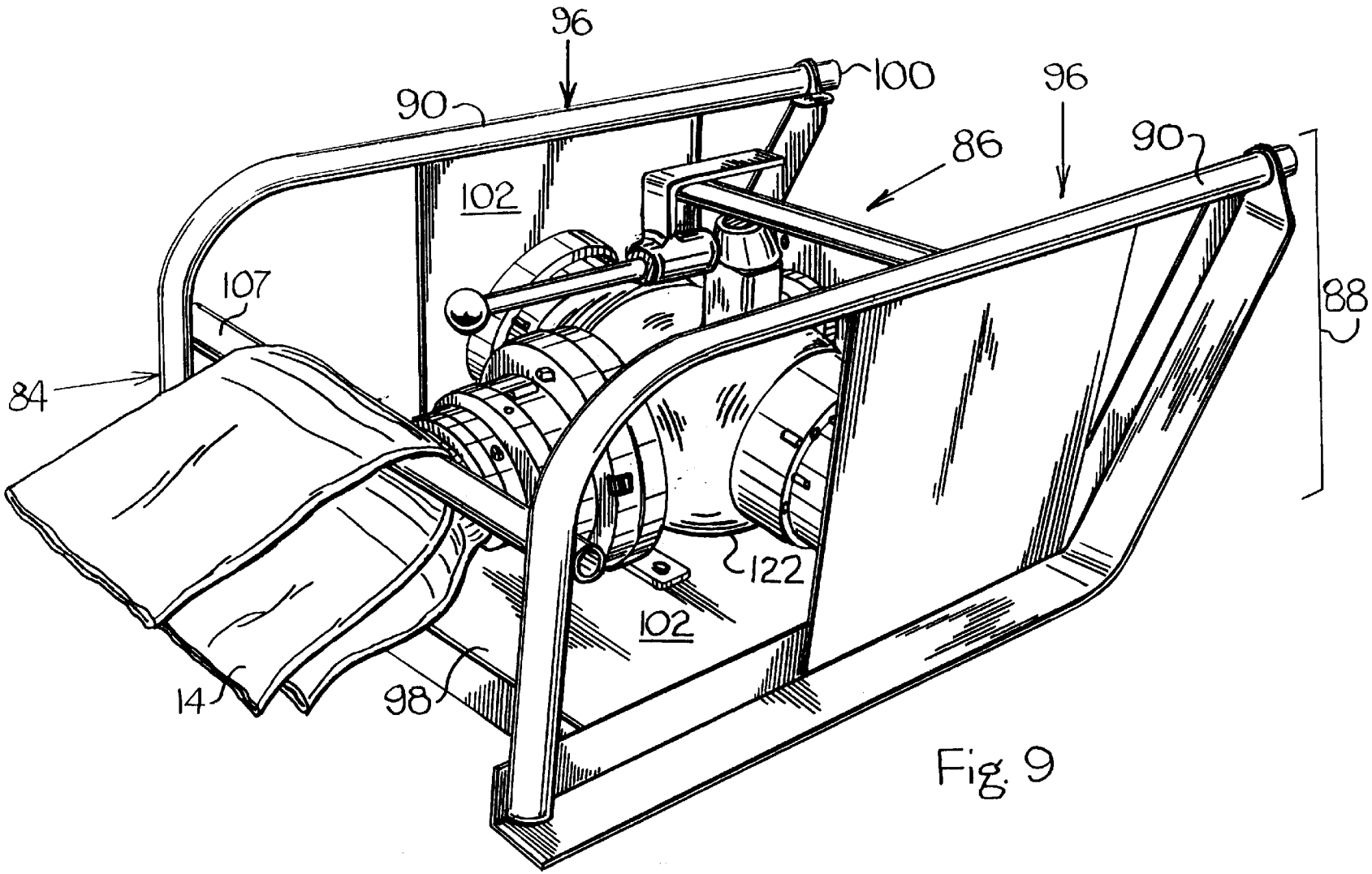
FIG. 9 is an elevated perspective view of a hose box with an open top portion, a four-way hydrant valve inserted into the box, and a double folded section of hose adjacent a first end of the hose box.

In a second embodiment of the hose box 12, shown in detail in FIG. 9, the hose box 12 does not have joining members 103 adjacent the top portion 96 of the hose box 12. Instead, the top portion 96 of the hose box 12 is open, allowing a four-way hydrant valve 122 to be inserted into the internal cavity 102 of the hose box 12. In this embodiment, shown in FIG. 9, the four-way hydrant valve 122 replaces the dual hose connector 114. The supply hose 14 is still adjacent the hose box 12, but the supply hose 4 is connected directly to the four-way hydrant valve 122. Slack in the supply hose 14 can be provided by connecting the supply hose 14 to the four-way hydrant valve 122, placing the four-way hydrant valve 122 in the hose box 12, and pulling a folded layer of supply hose 14 through the first end 84 of the hose box 12 and looping a portion of the hose around or over a transverse support member 107. Once the hose box 12 has been deployed from the ejection mount 10, the four-way hydrant valve 122 can be lifted out of the hose box 12, through the open top portion 96 of the hose box 12 and carried to the nearest hydrant, fire truck, or other water source. The looped portion of the hose provides the slack to permit movement of the hydrant valve 122. The hydrant valve 122 can be secured in the hose box 12 in any conventional manner, such as straps, quick release devices, etc.

In either the first or second embodiments, hose box 12 should be durable enough to withstand a drop from a fire truck, yet light enough for one person to lift. Moreover, hose box 12 should be designed to survive an impact with concrete or other paved surface. Steel is the preferred construction material, but other metals or composites may be used.

Operation begins by attaching an ejection mount 10 to a fire truck, positioning or connecting a supply hose 14 to a releasable hose box 12, connecting the releasable hose box 12 to the ejection mount 10, releasing the hose box 12 from an ejection mount 10, moving a fire truck in a forward motion away from the hose box 12, and paying the supply hose 14 from the hose bed of the fire truck. To accomplish these steps, any one of the aforementioned embodiments of the hose box 12 is attached to the ejection mount 10, as shown generally in FIGS. 1–3, by moving the pivot wall 38 of the ejection mount 10 into the loaded position. The obtuse shaped members 92 on the hose box 12 slide upwardly between the pivot wall 38 and box guide rails 40, 44. When the hose box 12 is seated in the ejection mount 10, a pressure release knob 61 is activated and the pivot wall 38 is manually pressed toward the back wall 26. As shown in FIG. 1, the hose box 12 then rests on the box support legs 34 and is held in place by the box guide rails 40, 44 on the pivot wall 38. A safety interlock prevents the hose box 12 from being removed from the ejection mount 10 until the activation switch is energized. Moreover, a second interlock prevents a hose box 12 from being deployed while the ejection mount 10, if equipped with a swing out hinge mount 78, is pivoted away from a rear portion of the fire truck.

The actuator assembly 50 is preferably powered by a fluid, such as air. To deploy any embodiment of the hose box 12, an operator stops a rear portion of the fire truck near a hydrant or other water source and activates the actuator assembly 50, preferably by energizing the activation switch from inside of the passenger compartment of the truck. Shown generally in FIGS. 3–5, tripping the activation switch causes the fluid routing switch 56 to open, and a fluid such as air is directed into jack 58 and the pressure release valve 60. As pressure builds in the jack 58, the jack extension 64 extends away from the jack body 62, depressing the attached lever 66. The downward motion of lever 66 causes the chain 68 to rotate the sprocket 74. The bias spring 70, connected to the chain 68 and the spring mount 72, creates tension in the chain 68. The rotation of the sprocket 74 attached to pivot wall shaft 36 causes a lower end of pivot wall 38 to move in a forwardly direction, pivotally away from back wall 26. When the pivot wall 38 is completely extended and clear of the box support legs 34, as shown in FIG. 4, the hose box 12 slides along the box guide rails, preferably lined with a low friction material such as plastic 124, past the ejection mount 10, and onto the ground or other surface. It should be appreciated that any activator means can be employed to pivot the pivot wall 38. While an air driven means are preferred, any suitable fluid can be used. In addition, other mechanical or electrical devices, such as cables, mechanical linkages, levers or motors can be used to rotate pivot wall shaft 36.

In the preferred embodiment, the supply hose 14 is connected to the hose box 12 via the dual hose connector 114 and unrolls a length approximately equal to the height of the hose box 12 above the ground. Once the hose box 12 impacts the ground, the weight of the hose box 12 allows the supply hose 14 to pay out as the truck resumes its forward motion. Optional light 116 activates, warning of the deployment of hose box 12 and the payed supply hose 14. Additional safety precautions include positioning reflective tape 126 on the hose box 12 and painting the hose box 12 a bright color, such as yellow. It should be noted that the truck does not need to come to a complete stop before discharging the hose box 12, but this is the preferred method. The hose 101 is removed and the hydrant connector C attached to a hydrant to allow water to flow from the hydrant through the hose 101 and dual hose connector 114 into the supply hose 14 and hence to a conventional firefighting nozzle.

In a second embodiment, the hose box 12 contains a conventional four-way hydrant valve 122 instead of a 25-foot folded hose 101 section. In this embodiment, the hose box 12 is discharged in the same manner as described in the preferred embodiment. However, the hose box 12 may be discharged further than 25 feet from the hydrant, provided there is more than 25 feet of supply hose 14 doubled over itself. The hydrant valve 122 may then be removed from the hose box 12 and carried to the hydrant.

Thus, the present invention provides an expedient, safe way for paying fire engine supply hose. Hose can be deposited at a precise location from inside the fire truck without consuming a firefighter's valuable time or exposing the firefighter to non-fire related safety risks. Moreover, once the hose has been deployed, its exact location can be determined by motorists, pedestrians and emergency personnel.

The invention has been described with reference to the preferred embodiment. Obvious modifications and alterations will occur to others upon reading and understanding the preceding detailed description. It is intended that the invention be construed as including all such modifications and alterations insofar as they come within the scope of the appended claims or the equivalents thereof.

I claim:

1. A fire hose paying device, comprising:

an ejection mount;

a hose box releasably loadable onto and expellable from said ejection mount; and a supply hose attached to said hose box.

2. The fire hose paying device as claimed in claim 1, said ejection mount comprising:

a base;

a first sidewall positioned adjacent a first side of said base;

a second sidewall positioned adjacent to a second side of said base;

a back wall, having a first end and a second end, said back wall positioned adjacent to said first sidewall and said second sidewall;

at least one hose box support leg positioned adjacent said back wall;

a rotatable pivot wall shaft positioned adjacent said first end of said back wall, between said first and second sidewalls;

a pivot wall connected to said pivot wall shaft, said pivot wall having a first guide rail positioned adjacent a first side of said pivot wall, a second guide rail positioned adjacent a second side of said pivot wall, and forming hose box support recesses corresponding to said at least one box support leg; and an actuator assembly connected to said pivot wall shaft, wherein said actuator assembly rotates said pivot wall shaft to move said pivot wall.

3. The fire hose paying device as claimed in claim 1 wherein said ejection mount is attached to a swing-out mount.

4. The fire hose paying device as claimed in claim 3 wherein a swing-out mount is attachable to a vehicle.

5. The fire hose paying device as claimed in claim 1 wherein said ejection mount is securely bolted directly to a vehicle.

6. The fire hose paying device as claimed in claim 2 wherein said actuator assembly is powered by air.

7. The fire hose paying device as claimed in claim 1, said hose box comprising:

a first end;

a second end spaced from said first end;

a pair of spaced sidewalls connecting said first end and said second end; and, a base connecting said pair of sidwalls;

wherein said first end, said second end, said pair of sidewalls, and said base define a cavity.

8. The fire hose paying device as claimed in claim 7 wherein said first and second sidewalls are each formed by a substantially L-shaped member and a substantially obtuse shaped member.

9. The fire hose paying device as claimed in claim 7 wherein joining members connect said first end and said second end, adjacent said top portion of said hose box, and form an internal cavity with said first end, said second end, said first sidewall, said second sidewall, and said base.

10. The fire hose paying device as claimed in claim 7 wherein said hose box further comprises a movable gate positioned adjacent said second end of said hose box.

11. The fire hose paying device as claimed in claim 10 wherein a first side of said gate is pivotally connected adjacent said top portion of said hose box.

12. The fire hose paying device as claimed in claim 11 wherein said gate is lifted into an open position with the assistance of a graspable gate knob.

13. The fire hose paying device as claimed in claim 10 wherein a second side of said gate is pivotally connected adjacent said bottom portion of said hose box, with a first side pivotally movable away from said top portion of said hose box.

14. The fire hose paying device as claimed in claim 13 wherein said gate is held in a closed position by a movable latch.

15. The fire hose paying device as claimed in claim 7 wherein a four-way hydrant valve is positioned in said internal cavity of said hose box.

16. The fire hose paying device as claimed in claim 7 wherein said hose box further comprises a light positioned in a protected area of said hose box.

17. The fire hose paying device as claimed in claim 7 wherein a folded section of fire hose is inserted into said internal cavity of said hose box.

18. The fire hose paying device as claimed in claim 7 wherein said hose box further comprises a dual hose connector positioned adjacent said first end of said hose box.

19. A method of paying a supply hose from a vehicle comprising the steps of:

positioning an ejection mount adjacent to said vehicle;

loading a releasable hose box onto said ejection mount;

connecting said supply hose to said releasable hose box;

expelling said hose box from said ejection mount; and moving said vehicle in a forward motion, away from said hose box.

20. A device for paying out fire hose from a fire truck, comprising:

a fire truck;

an ejection mount positioned adjacent a rear portion of said fire truck, said ejection mount comprising:

a base;

a first sidewall positioned adjacent a first side of said base;

a second sidewall positioned adjacent to a second side of said base;

a back wall, having a first end and a second end, said back wall positioned adjacent to said first sidewall and said second sidewall;

at least one box support leg positioned adjacent said back wall;

a rotatable pivot wall shaft positioned adjacent said first end of said back wall, between said first and second sidewalls;

a pivot wall connected to said pivot wall shaft, said pivot wall having a first guide rail positioned adjacent a first side of said pivot wall, a second guide rail positioned adjacent a second side of said pivot wall, and forming box support recesses corresponding to said at least one box support leg, wherein said first and second guide rails are lined with plastic;

an actuator assembly connected to said rotatable pivot wall shaft, said actuator assembly comprising:

a fluid inlet valve;

a routing valve connected to said fluid inlet valve, said routing valve having a fluid routing switch;

a jack connected to said routing valve, said jack having a body and a jack extension;

a pressure relief valve connected to said routing valve;

a lever connected to said jack extension;

a chain connected to said lever;

a bias spring connected between said chain and spring mount; and a sprocket connected to a first end of said pivot wall shaft and engaging said chain; and a hose box removably connected to said ejection mount, said hose box comprising:

a first end;

a dual hose connector positioned adjacent said first end;

a second end positioned opposite said first end;

a first sidewall positioned adjacent said first end and said second end, said first sidewall formed by a substantially L-shaped member and a substantially obtuse-shaped member;

a second sidewall positioned opposite to said first sidewall, said second sidewall formed by a substantially L-shaped member and a substantially obtuse-shaped member;

a top portion positioned adjacent said first end, said second end, said first sidewall, and said second sidewall, said top portion having joining members connecting said first end and said second end;

a base plate, positioned opposite to the top portion and connecting the first and second sidewalls, forming a bottom portion;

a movable gate positioned adjacent said second end of said box, said gate having a first side and a second side, said second side pivotally connected adjacent said bottom portion of said hose box, with said first side pivotally movable away from said top portion of said hose box, and held in a closed position by a movable latch, wherein said first end, said second end, said first sidewall, and said second sidewall, said top portion, and said bottom portion form an internal cavity;

a supply hose connected to said dual hose connector; and a segment of folded hose, inserted into said internal cavity in said hose box and connected to said dual hose connector.

21. The fire hose paying device as claimed in claim 1 wherein said ejection mount comprises:

a pivot wall; and an actuator assembly operatively connected to said pivot wall, said actuator assembly configured to move said pivot wall from a first position to a second position to expel said hose box from said ejection mount.

22. A fire hose paying device comprising:

an ejection mount, comprising:

a pivot wall; and an actuator assembly operatively connected to said pivot wall, said actuator assembly powered by air and configured to move said pivot wall from a first position to a second position to expel said hose box from said ejection mount;

a hose box releasably loadable onto and expellable from said ejection mount, said hose box comprising:

a first end;

a second end spaced from said first end;

a pair of spaced sidewalls connecting said first end and said second end; and a base connecting said pair of sidewalls, wherein said first end, said second end, said pair of sidewalls, and said base define a cavity; and a supply hose attached to said hose box.

23. A fire hose paying device comprising:

an ejection mount;

a hose box releasably loadable onto and expellable from said ejection mount, said hose box comprising:

a first end;

a second end spaced from said first end;

a pair of spaced sidewalls connecting said first end and said second end; and a base connecting said pair of sidewalls, wherein said first end, said second end, said pair of sidewalls, and said base define a cavity;

a four-way hydrant valve positioned in said cavity of said hose box; and a supply hose attached to said hose box.

24. A fire hose paying device comprising:

an ejection mount;

a hose box releasably loadable onto and expellable from said ejection mount, said hose box comprising:

a first end;

a second end spaced from said first end;

a pair of spaced sidewalls connecting said first end and said second end; and a base connecting said pair of sidwalls, wherein said first end, said second end, said pair of sidewalls, and said base define a cavity;

a dual hose connector positioned in said cavity of said hose box; and a supply hose attached to said hose box.

25. The fire hose paying device as claimed in claim 1, wherein said ejection mount comprises:

a discharge device; and an actuator assembly connected to said discharge device and configured to move said discharge device from a first position to a second position to expel said hose box from said ejection mount.

* * * * *